US011239033B2

(12) United States Patent
Marinkovic et al.

(10) Patent No.: US 11,239,033 B2
(45) Date of Patent: Feb. 1, 2022

(54) MONITORING DEVICE FOR SWITCHING SYSTEMS

(71) Applicant: ABB Schweiz AG, Baden (CH)

(72) Inventors: Stevan Marinkovic, Wettingen (CH); Kai Hencken, Lörrach (DE); Andrea Bianco, Sesto San Giovanni (IT); Yannick Maret, Daettwil (CH)

(73) Assignee: ABB Schweiz AG, Baden (CH)

( * ) Notice: Subject to any disclaimer, the term of this patent is extended or adjusted under 35 U.S.C. 154(b) by 35 days.

(21) Appl. No.: 16/620,720

(22) PCT Filed: Jun. 8, 2017

(86) PCT No.: PCT/EP2017/064018
§ 371 (c)(1),
(2) Date: Dec. 9, 2019

(87) PCT Pub. No.: WO2018/224155
PCT Pub. Date: Dec. 13, 2018

(65) Prior Publication Data

US 2020/0203088 A1 Jun. 25, 2020

(51) Int. Cl.
*H01H 1/00* (2006.01)
*H01H 11/00* (2006.01)
(Continued)

(52) U.S. Cl.
CPC ..... *H01H 1/0015* (2013.01); *H01H 3/30* (2013.01); *H01H 9/563* (2013.01); *H01H 11/0062* (2013.01)

(58) Field of Classification Search
USPC ..... 361/115
See application file for complete search history.

(56) References Cited

U.S. PATENT DOCUMENTS

2009/0144019 A1* 6/2009 Elsner ..... H01H 1/0015 702/158
2014/0376000 A1 12/2014 Swanson et al.
(Continued)

FOREIGN PATENT DOCUMENTS

EP 1006537 A1 6/2000
EP 1006537 * 7/2000
(Continued)

OTHER PUBLICATIONS

Russian Patent Office, Office Action issued in corresponding Application No. 2019104824, dated Jan. 16, 2020, 9 pp.
(Continued)

*Primary Examiner* — Toan T Vu
*Assistant Examiner* — Xuan Ly
(74) *Attorney, Agent, or Firm* — Greenberg Traurig, LLP

(57) ABSTRACT

A monitoring device for switching systems including a contact assembly having at least a movable contact and a kinematic chain for actuating said movable contact and opening/closing the contact assembly. The monitoring device includes: an accelerometer adapted to be positioned on a moving part of the switching system and capable of determining acceleration data of the moving part; a control unit including: a first processing unit adapted to receive acceleration data measured by the accelerometer and calculate timing instants of predetermined events and motion parameters related to the switching system; a second processing unit adapted to receive the timing instants of predetermined events and the motion parameters and to use at least one timing instant and at least one motion parameter to calculate electro/mechanical parameters of the switching system.

20 Claims, 5 Drawing Sheets

(51) Int. Cl.
*H01H 3/30* (2006.01)
*H01H 9/56* (2006.01)

(56) References Cited

U.S. PATENT DOCUMENTS

| | | | |
|---|---|---|---|
| 2016/0033556 | A1 | 2/2016 | Mueller et al. |
| 2017/0047186 | A1 | 2/2017 | Chen et al. |

FOREIGN PATENT DOCUMENTS

| | | | | |
|---|---|---|---|---|
| EP | 2405454 | | * | 1/2012 |
| EP | 2405454 | A1 | | 1/2012 |
| WO | 2007121592 | A1 | | 11/2007 |
| WO | 2015091972 | A1 | | 6/2015 |

OTHER PUBLICATIONS

European Patent Office, International Search Report & Written Opinion issued in corresponding Application No. PCT/EP2017/064018, dated Feb. 1, 2018, 13 pp.

* cited by examiner

MONITORING DEVICE FOR SWITCHING SYSTEMS

The present invention relates to a device for monitoring electro/mechanical parameters and other properties of a switching system. In particular, the present invention relates to a device for monitoring electro/mechanical parameters of a medium voltage switchgear system by measuring the acceleration on one or more moving parts of the kinematic chain that actuates the movable contact(s) of said switchgear. Moreover, the present invention also relates to a switching system, e.g. a medium voltage switchgear system including a device for monitoring electro/mechanical parameters thereof, as well as a method for monitoring electro/mechanical parameters and other properties of a switching system.

Even if in the following description reference will be primarily made to a medium voltage switchgear system, the device of the present invention is of more general applicability being usable for low, medium and high voltage applications.

It is known that switching systems, e.g. medium voltage switchgears, are widely used in power networks and as such have to be reliable. Consequently, there is an increased interest in providing them with additional monitoring functionality so as to prevent possible failures. Such failures can be electrical as well as mechanical and—in order to prevent the latter—a number of ways to analyze the mechanical system have been proposed in the literature.

One important property of a switchgear, e.g. a circuit breaker, is on the one hand the contact distance and on the other hand the velocity of the movable contact at contact closure or opening. It is known that contact speeds have to be within a specified range in order for the breaker to be able to interrupt the current. Therefore, each circuit breaker produced is normally subjected to a well-defined procedure of testing the mechanical properties of the breaker by measuring the travel curve, i.e., the linear and/or rotational displacements of the moving parts as a function of time. These measurements are then analyzed to extract the features that define the relevant mechanical properties.

These measurements must be performed during assembly in the factory and the measurement system is normally removed after the circuit breaker is put in the field.

However, in order to assess continuously the status and health of the circuit breaker, it would be useful that similar measurements could be performed also in the field, during normal operation. Furthermore, in case of field measurements, it would be desirable to extract more features, which could describe a possible failure of the circuit breaker due to material fatigue or other problems over time.

Measurement of the motion of the movable contact of a circuit breaker has been investigated mostly using travel sensors, rotary encoders, and in some cases also high-speed cameras or optical systems.

It is also known to use accelerometers as sensors for circuit breaker monitoring. Accelerometers have been used especially attached to stationary, non-moving, parts in order to measure vibrations with more or less success. These measurements are a combination of many mechanical and ambient effects and it is normally very difficult to determine the mechanical health of the circuit breaker parts using only these signals.

Signals derived from accelerometers have therefore been mostly used to detect the time when an impact happens between the two contacts. Another application is the detection of "noise", when the friction in some parts or the vibration of the whole breaker starts to become large.

Therefore, monitoring methods based on accelerometers are usually limited on measuring time instants when the impacts happened or some vibrations occurred, which is influenced by ambient temperature or the place where the breaker is installed or vibrations of the other equipment nearby. They also measure indirect effects not directly related to the primary motion. Hence, the present disclosure is aimed at providing a monitoring device for switching systems, in particular medium voltage switchgears, which allows overcoming at least some of the above-mentioned shortcomings.

In particular, the present invention is aimed at providing a monitoring device for switching systems that can be used for both testing in factory during manufacturing and on-site monitoring when installed and in operative conditions.

Furthermore, the present invention is aimed at providing a monitoring device for switching systems that can be used to detect a number of electro/mechanical parameters indicative of the status of various components of the switching system, thereby reducing the risk of failures.

Also, the present invention is aimed at providing a monitoring device for switching systems in which a reduced number of sensors is used, thereby reducing the manufacturing and maintenance costs.

Thus, in a first aspect the present invention relates to a monitoring device for switching systems, in particular medium voltage switchgears, comprising a contact assembly having at least one movable contact and a kinematic chain for actuating said movable contact and opening/closing said contact assembly. The monitoring device according to the invention is characterized in that it comprises:

- an accelerometer adapted to be positioned on a moving part of said switching system and capable of determining acceleration data of said moving part;
- a control unit comprising:
  - a first processing unit adapted to receive acceleration data measured by the accelerometer and calculate timing instants of predetermined events and motion parameters related to said switching system;
  - a second processing unit adapted to receive said timing instants of predetermined events and said motion parameters and to use at least one timing instant and at least one motion parameter to calculate electro/mechanical parameters of said switching system.

Thanks to choice of an accelerometer as sensor and its positioning on a moving part of the switching system, the above-mentioned problems can be avoided.

Indeed, using an accelerometer directly on the moving part of a switching system allows direct and accurate mechanical measurements of said moving part and the whole kinematic chain for greatly lower cost and sensor installation complexity compared to existing travel curve and velocity measurement devices.

Moreover, the monitoring device according to the present invention differs from the previous devices based on accelerometers attached to the stationary parts, which attempt to derive these values indirectly, and suffer from ambient effects. Conversely, the device of the present invention provides direct measurement of acceleration data of a moving part of the switching system.

Using these data, it is possible to calculate motion parameters (acceleration, velocity, displacement) of the moving part as well as timing instants of predetermined events (e.g., a time-localized event, such as opening/closing of the contacts, start/finish of the movement of the moving part, impact with a damper of said switching system).

Then, a number of physical parameters of the mechanical system and consequently the status of some of the components of the switchgear, e.g. the contacts, the damper, or the drive, can be calculated based on at least one of said motion parameters and at least one of said timing instants of predetermined events.

In practice, in the device according to the present invention, the use of an accelerometer on a moving part allows determining different properties using the same sensor. For instance, the accelerometer data can be used to identify impacts, that is, specific points where the contacts touch, the derived velocity data can be used to determine critical speeds that are needed for the successful operation of the breaker and finally the displacement can be used to determine changes coming from wear of the contacts or mechanical parts.

In addition, the integration operation to go from acceleration to velocity and displacement is much more robust compared to the inverse approach, e.g., starting with a travel sensor. In other words, one advantage compared to e.g. a travel sensor is the robustness of the approach with respect to integration. Whereas in principle velocity and acceleration can also be calculated by taking the derivative of the travel, these operations are not mathematically stable and result in noisy and therefore unusable results.

For example the instant of contact closure is easily detectable with an accelerometer but not with a travel sensor. Then, with the device of the present invention, it is also possible to determine the distance and the velocity at this instant in time. All three properties can also be determined using separate sensors, but in the device of the present invention they are available using only the accelerometer. Moreover, since they are derived from the same sensor, they are also (time) synchronous to each other.

Preferably said timing instants of predetermined events is calculated by detecting one or more of the following: abrupt change in the acceleration value, appearance or disappearance of a specific frequency content in the acceleration pattern, increasing above or decreasing below a specific acceleration threshold value, abrupt change in the acceleration direction.

Examples of time-localized events whose timing instant can be calculated are: opening of the contact assembly, closing of the contact assembly, start of the movement of said moving part, finish of the movement of said moving part, impact with a damper of said switching system, energization of an actuating coil of said switching system.

In an embodiment of the monitoring device according to the present invention, the electro/mechanical parameter of the switching system that is determined is the contact erosion status; in such a case, the calculated timing instant is the contact opening/closing instant and the calculated motion parameter is the absolute position of the movable contact at said opening/closing instant. This position determines directly the physical length of the mentioned contact or the length of the contact gap between the contacts.

In a further embodiment, the monitoring device of the present invention can be used to determine the spring travel status of an actuating spring of said switching system, said status being determined by calculating the difference in the position at the start/end timing instants with the position at the contact opening/closing instants.

In another embodiment of the monitoring device according to the present invention, the electro/mechanical parameter of the switching system that is determined is the movable contact speed at predetermined timing instants, in particular the movable contact speed at closing/opening.

Another example of an electro/mechanical parameter of the switching system that can be determined with the device of the present invention is the movable contact over-travel on opening/closing, said over-travel being determined as positions/instants at the timing instant where the velocity change signs.

In a further embodiment of the monitoring device according to the present invention, the electro/mechanical parameter of the switching system that is determined is the status of a damping element of said switching system, said status being determined as the difference of the position, velocity or timings at the timing instant of hitting the damper and the position, velocity or timings at the timing instant of the next over-travel.

It is worth noting that the previously described embodiments can be also combined, since—as previously said—in the monitoring device according to the present invention, the use of an accelerometer on a moving part allows determining different properties using the same sensor. In a particular embodiment, the monitoring device of the present invention comprises—for each phase of the switching system associated thereto—an accelerometer adapted to be positioned on a moving part of each phase of said switching system and capable of determining acceleration data of said moving part. In such a case, the control unit conveniently comprises a third processing unit, which is adapted to determine a difference or a commonality in behavior between the phases.

In other words, by comparing acceleration data related to similar points on the various phases, it is possible to determine whether the operation of the phases is synchronous or asynchronous, or whether there is a common behavior between the phases, e.g. due to full-body movements of the switching system.

In practice, in a three-phase switching system it may be possible to place three accelerometers, one on each phase/pole in a symmetric way, to measure each of the three symmetric kinematic chains connected to the three separate moving contacts, which are excited by the same source. With this embodiment, it is possible to detect the possible asymmetries in the mechanical system, which could be caused by, e.g., an asymmetric wear of one phase or by the asymmetry in the system itself, e.g, due to changes in the geometric distances of the system. By combining, e.g., the instance of contact closure of the three poles a problem with a delayed switch-off of one of the phases can be avoided.

In a further particular embodiment of the present invention, the monitoring device for switching systems comprises a contact assembly having at least a movable contact and a kinematic chain for actuating said movable contact and opening/closing said contact assembly. The monitoring device is characterized in that it comprises:

- a plurality of accelerometers adapted to be positioned at different locations of said kinematic chain of said switching system adapted to be positioned on a moving part of said switching system and capable of determining acceleration data of said moving part;
- a control unit comprising:
  - a first processing unit adapted to receive acceleration data measured by said accelerometers and calculate timing instants of predetermined events and/or motion parameters related to said switching system;
  - a second processing unit adapted to receive said timing instants of predetermined events and/or said motion parameters and to use at least one timing instant and at least one motion parameter and/or at least two timing instants and/or at least two motion parameters to calculate electro/mechanical parameters of said switching system.

In a particular embodiment, the control unit conveniently comprises a fourth processing unit, which is adapted to determine discrepancies indicative of a variation of behavior of said kinematic chain, for instance discrepancies between the values detected by the accelerometers at various locations of the kinematic chain and theoretical values for the ideally connected mechanical chain that may indicate slackness, loose connections or fatigue on the kinematic chain.

For instance, in a possible embodiment of the present invention, two or more accelerometers can be placed on a single kinematic chain with a focus to measure separate parts, which are linked together in such a way that they should move together at the pre-defined scenario dependent on the mechanical design. This embodiment would allow detecting possible defects/slackness on the linkages between the moving parts, by analysing the differences between the mechanical data (acceleration, velocity, travel) between different points in the system. In one preferred embodiment, one uses the time delay between "impact" signals, which are a direct indication of the slackness. In another the signal is, e.g., twice integrated to get a travel curve. By making a geometric transformation the two travel curves can be made comparable and by this a "delay", that is a difference in position, can be determined.

In another possible embodiment of using multiple accelerometers, two or more accelerometers can be positioned on a single mechanical part on the kinematic chain at positions that are connected by a fixed connection, such that they should move synchronously at the same time once the driving force is applied. The goal of this embodiment is to detect possible defects in elasticity of the mechanical part, such as material fatigue, and to measure the stresses endured during the breaker operation, caused by torsion, bends or specific oscillations of the part—to name a few. A preferred embodiment would use the two signals and transform them into the same reference frame. By then taking the difference of the two signals, the common motion and the relative motion can be separated. A change of the material properties, e.g., the Young modulus or the attenuations, could be detected by e.g. looking at the frequency or damping of this relative motion.

This latter embodiment can be combined with the previous one (placement of accelerometers on different parts of the kinematic chain) so as to measure and analyse how the possible changes in mechanical characteristics of one part of the mechanical chain affect the mechanical characteristics of other parts in the chain. The goal of the embodiment would be to isolate the single failures of the mechanical chain which alter the functionality but do not cause hard fault of the system before they cause the failure of the full system.

In another particular embodiment of the present invention, the monitoring device is provided with a further accelerometer that is adapted to be connected to a reference point in the breaker system, which should be fixed in the ideal case, but will not in reality due to the non-rigidness of the mounting of the breaker The goal of the embodiment is to correct for the absolute movement of the breaker, once the specific points on the moving parts within a system are analysed. Furthermore, one can detect an (excessive) movement of the breaker, which should not be present, but could lead to early problems and therefore is not allowed.

For instance, the monitoring device can be provided with a further accelerometer connected to a frame of said switching system and is capable of determining acceleration data deriving from full-body movements of said switching system. The collected data concerning full-body movements are then used to correct/compensate the acceleration data of the moving part so as to obtain a more precise determination of the actual movement of the moving part. In such a case, the control unit conveniently comprises a fifth processing unit adapted to use said acceleration data deriving from full-body movements to correct acceleration data of said moving part.

For the purposes of the present invention, the various processing units that may be present in the monitoring device (i.e., first to fifth processing unit) can be part of the same or of different physical objects.

In a further aspect, the present invention also relates to a method for monitoring a switching system comprising a contact assembly having at least a movable contact and a kinematic chain for actuating said movable contact and opening/closing said contact assembly. The monitoring method of the present invention is characterized in that it comprises the following steps:

- providing an accelerometer on a moving part of said switching system;
- determining acceleration data of said moving part;
- calculating, using said acceleration data, timing instants of predetermined events;
- calculating, using said acceleration data, motion parameters related to said switching system;
- calculating, using at least one of said timing instants and at least one of said motion parameters, electro/mechanical parameters of said switching system.

Thus, the method of the present disclosure is based on a measurement of the acceleration directly at defined points on the moving parts in the switching system kinematic chain, and subsequent integration of the acceleration signal to calculate the velocity and the movement/travel of this point and therefore the velocity and movement/travel of the mechanical part on which it is attached.

The acceleration data are also used to calculate timing instants of predetermined events, and such timing instants are then used together with the acceleration/velocity/displacement (AVD) signals (i.e. motion parameters) to calculate mechanical parameters of the system such as: contact erosion, contact spring force, over-travel, asymmetries, slacks, bends, and more.

For instance, the method of the present invention can be used to detect contact erosion phenomena. In such a case, the acceleration data are used to determine the contact opening/closing instant and the movable contact absolute position at said opening/closing instant. The change of travel over time can be then tracked thereby allowing to determine any change thereof with great accuracy.

As a further example, the movable contact speed at predetermined timing instants (e.g. at opening/closing) can be determined with great precision by determining—starting from the acquired acceleration data—the contact closing/opening instant and the movable contact speed at closing/opening.

In practice, the device of the present invention allows measuring a great number of electro/mechanical parameters of a switching unit continuously and directly, by using the low cost accelerometer technology.

A switching system comprising a monitoring device according to one or more of the previous claims is also part of the present invention.

Further features and advantages of the present invention will be more clear from the description of preferred but not exclusive embodiments of a monitoring device for switching systems according to the invention, shown by way of examples in the accompanying drawings, wherein.

Figure 1:
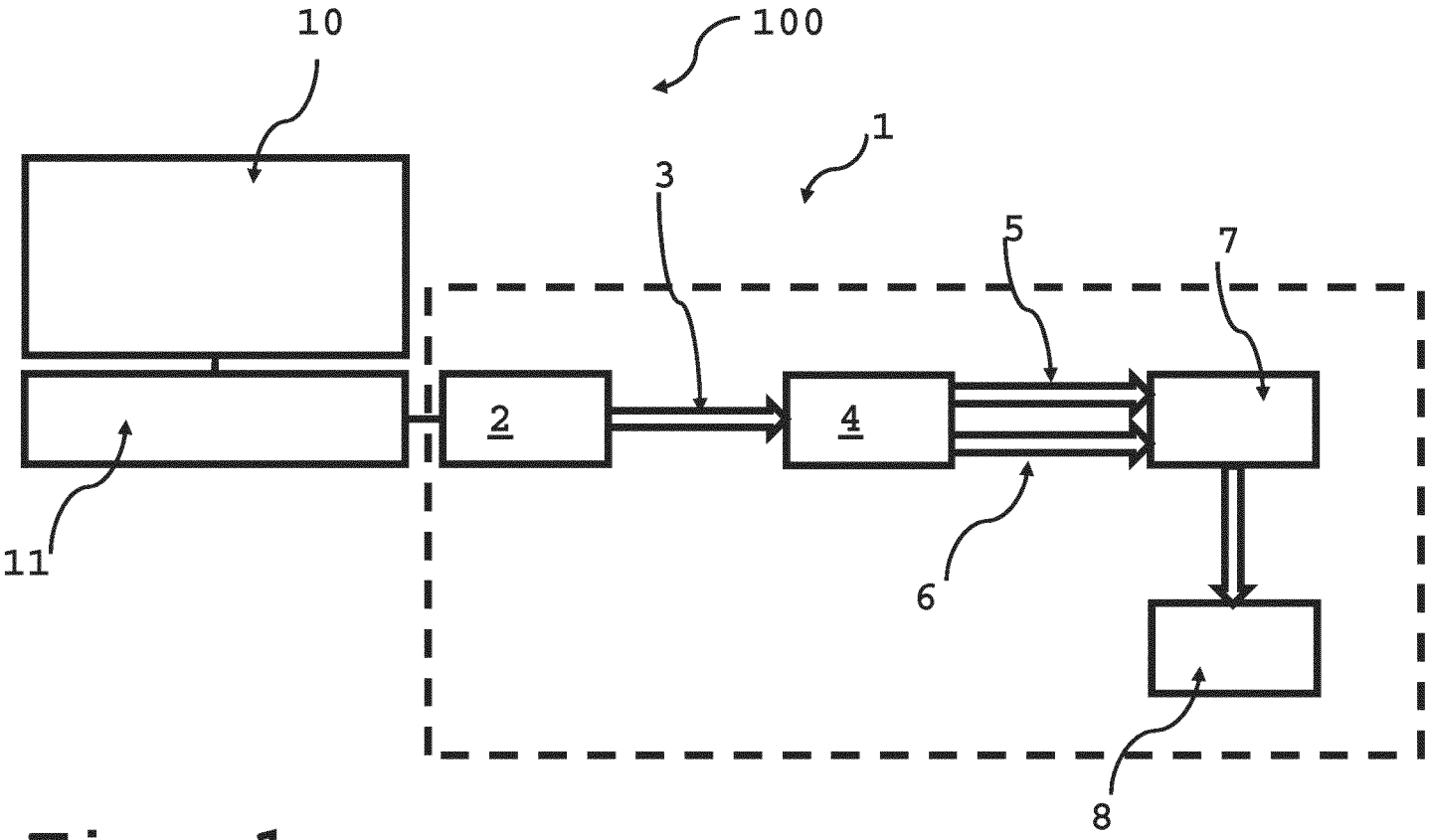
FIG. 1 is a schematic view of a first embodiment of a monitoring device for switching systems according to the invention.
Figure 2:
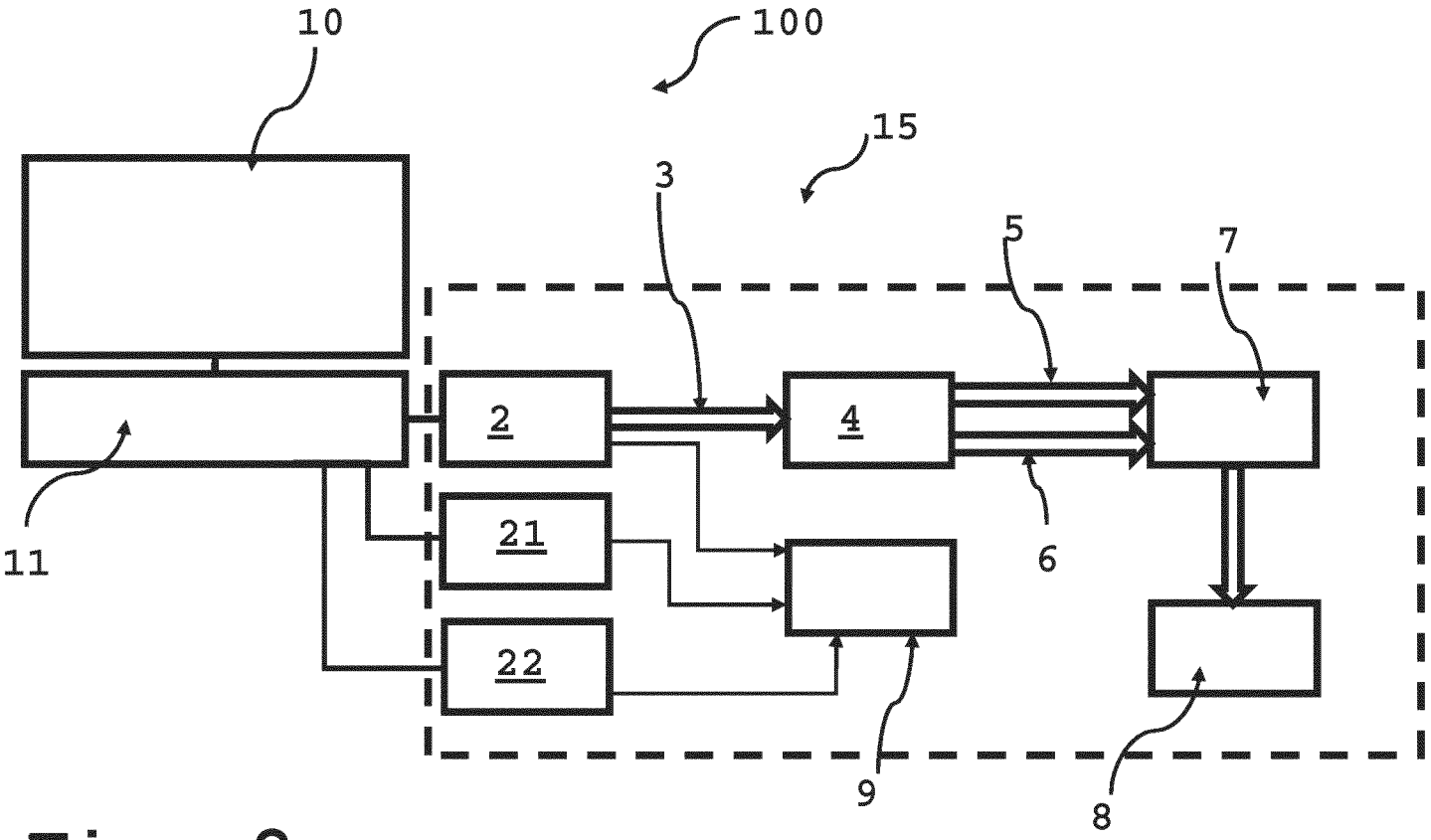
FIG. 2 is a schematic view of a second embodiment of a monitoring device for switching systems according to the invention.

With reference to the attached FIGS. 1 and 2—in its more general definition—the monitoring device 1, 15 according to the present invention is adapted to monitor a switching system 100 (e.g. a medium voltage circuit breaker) which generally comprises a contact assembly 10 having at least a movable contact and a kinematic chain 11 for actuating said movable contact and opening/closing said contact assembly 10.

The structure of the contact assembly 10 and kinematic chain 11 can be different depending on the kind of switching unit and range of voltage of use, but for the purposes of the present invention, they can be of conventional type and will not be described in more details.

One of the characterizing features of the monitoring device 1, 15 according to the present invention is given by the fact that it comprises at least one accelerometer 2 that is positioned on a moving part of the switching system 100 and is capable of determining acceleration data 3 of the moving part to which it is attached. The accelerometer can be of conventional type and its features (e.g., kind of technology, range of measure, sensitivity, number of axis, bandwidth . . . ) can be selected according to the needs.

Even if in principle the accelerometer 2 can be positioned on any moving part of the switching unit 100 (e.g., also on the moving contact) it is largely preferable to position it on the kinematic chain 11 between the actuator and the moving contact.

The acceleration data 3 detected by the accelerometer 2 are sent to a control unit which comprises a first processing unit 4 adapted to receive said acceleration data 3 measured by said accelerometer 2 and calculate timing instants 5 of predetermined events and motion parameters 6 related to said switching system 100. Then, a second processing unit 7 is adapted to receive said timing instants 5 of predetermined events and said motion parameters 6 and to use at least one timing instant and at least one motion parameter to calculate electro/mechanical parameters 8 of said switching system 100.

Figure 3:
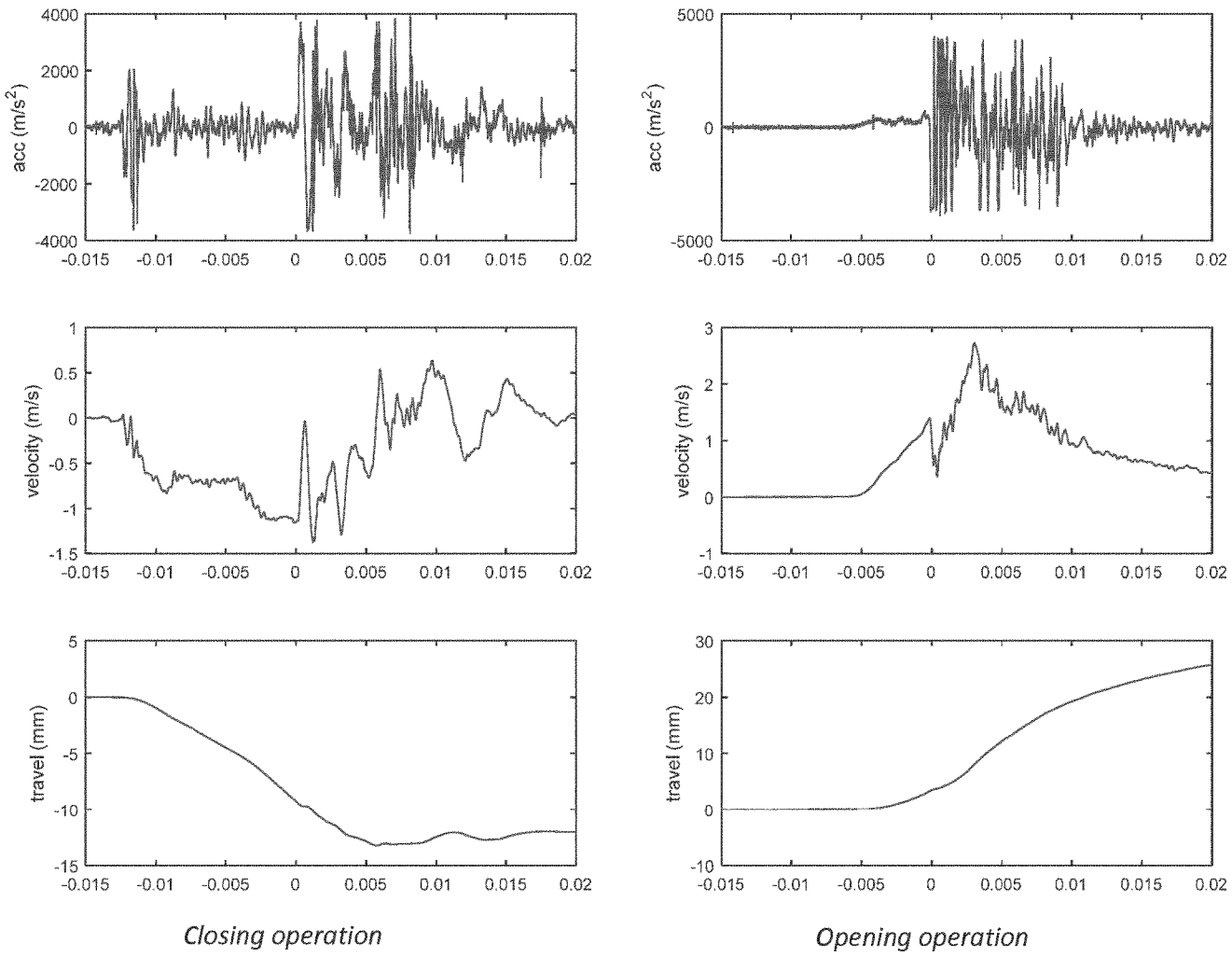
FIG. 3 shows AVD (Acceleration, Velocity, Displacements) diagrams for opening and closing operations.

For instance, with reference to FIG. 3, the accelerometer data 3 detected by the accelerometer 2 during the opening and closing operations can be used to determine AVD diagrams for contact opening/closure based on integration and double integration of the signal. The instant of contact opening/closure (time-localized event) can be seen in the acceleration diagram as well as in strong changes of the velocity, whereas the velocity and position of the contact at that instant (motion parameters) can be read off the other diagrams.

The device of the present invention can therefore be used to analyze the status of the switching unit and calculate a number of electro/mechanical parameters thereof.

Figure 4:
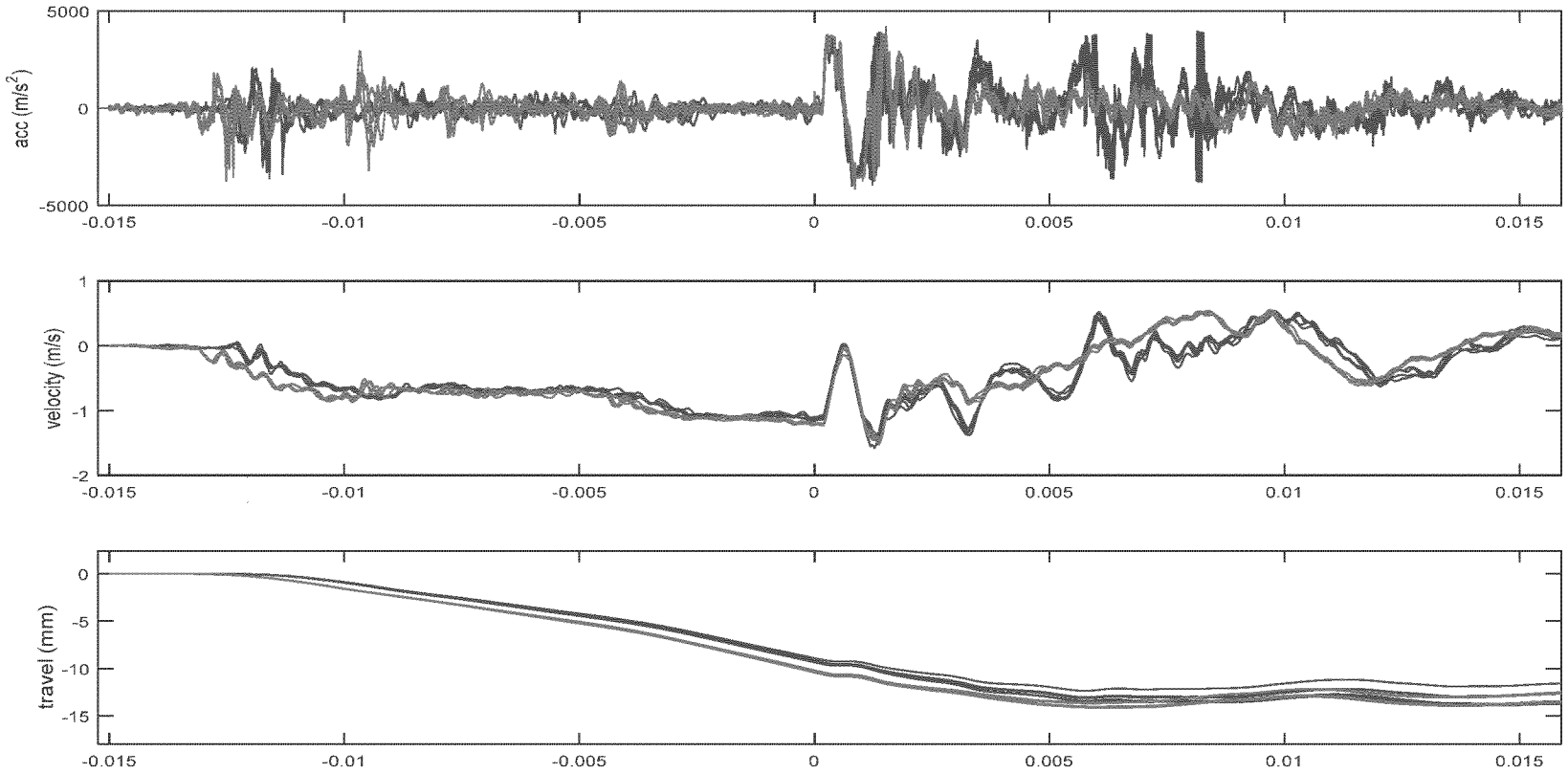
FIG. 4 shows diagrams for the determination of contact travel measurement and possible contact wear.

As an example, with reference to FIG. 4, contact wear due to erosion of material by the arc can be detected by comparing the contact travel curves over the time. As shown in the bottom diagram of FIG. 4, by measuring the contact travel between start of the movement and instant of closure it is possible to determine any change of travel with great accuracy, e.g. below 1 mm. In the diagram of FIG. 4, the curves have been aligned with respect to the contact closure instant, thereby allowing detecting a change of travel of the movable contact, possibly due to contact wear.

Figure 5:
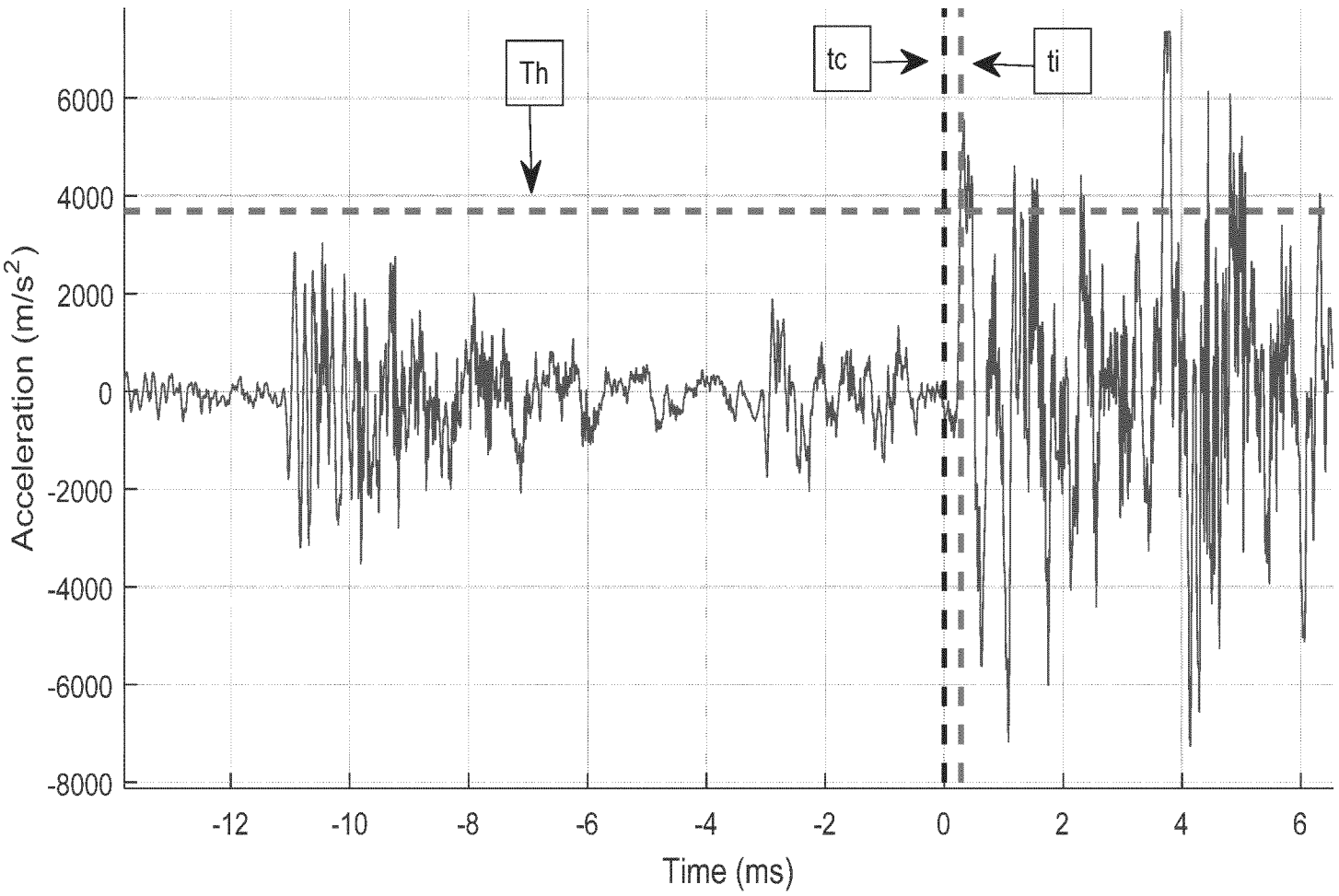
FIG. 5 show a diagram for the impact detection using threshold frequency values.

Thus, in a first embodiment, the monitoring device of the present invention can be used to analyze the status of the switching unit with respect to its current interruption capability. Important properties here are the total gap length, the contact wear due to erosion of material by the arc, and also the velocity with which the contacts open or close. This could be detected by analysis of the signal in order to detect the impact point of contact connection and separation, and then by the subsequent integration or double integration of the signal. With reference to FIG. 5, the impact can be detected using the crossing point of given threshold values of acceleration (Th), with a given frequency bandwidth. Similarly, the bouncing of the contacts at closing can be determined.

In general, the full travel curve of the contact can be calculated from the acceleration data determined by the accelerometer. However, due to the high accelerations, and inherent error accumulation after the double integration, a suitable error correction method should be used.

For instance, this could be in form of:

Declipping, where high G values which are out of the measurement range of the accelerometer are reconstructed analytically;

Detrend, where one takes the assumption that after a given time a velocity of the system should be 0, and then checks the final error in calculated velocity; Travel assumptions, where it is assumed that the final travel should be within a given range and then appropriate corrections are made;

External reference, where one would use an additional sensor with much coarser resolution to give the absolute values of the travel, while accelerometer would give the finer resolution of the relative values of the travel, e.g. by using the "open" and "close" switches already available in the breaker.

In a first particular embodiment of the monitoring device of the present invention comprises—for each phase of the switching system associated thereto—an accelerometer positioned on a moving part of each phase of said switching system and capable of determining acceleration data of said moving part. In such a case, the control unit conveniently comprises a third processing unit, which is adapted to determine a difference or a commonality in behavior between the phases. In this way, synchronicity measurement can be based on moment of impact detection, caused by the contact connection and separation. The difference in time of this impact would give the timewise representation of the system asynchronicity. Furthermore, using the integration of the accelerometer signal, the system can be compared for differences in travel or velocity of the symmetrical parts.

In a particular embodiment of the monitoring device of the invention, as the accelerometer measures movement of the point in reference to the earth surface, if the whole body of the breaker is moving, and there is a need to calculate the movement of a certain part of the breaker to the breaker body, there might be a need for a reference accelerometer to detect the movement of the breaker body, and therefore to determine the movement of the specific part within a breaker.

In such a case, the monitoring device 1 of the present invention can conveniently comprise a further accelerometer connected to a frame of the switching system 100 to determine acceleration data deriving from full-body movements of the switching system 100. The control unit then conveniently comprises a fifth processing unit, which use the acceleration data deriving from full-body movements to correct/compensate acceleration data of the moving part of the switching system 100. In practice, the accelerometers placed on the theoretically fixed parts of the breaker can be used to detect the small movements of the full frame of reference, and then this movements can be subtracted from any other accelerometer placed on the moving part within a breaker, to get the relative movement of this part (which is the mechanically relevant movement within a system) to the breaker frame of reference.

With reference to FIG. 2, in a particular embodiment of the present invention, the monitoring device 15 is provided with a plurality of accelerometers 2, 21, 22, which are positioned at different locations of the kinematic chain 11 of said switching system 100, and more in general on different moving parts of the switching unit.

Then, the control unit conveniently comprises a fourth processing unit 9, which determine whether there are discrepancies indicative of a variation of behavior of the kinematic chain. In practice—in this embodiment—the fourth processing unit 9 determines whether discrepancies between the detected values at various locations of the kinematic chain arise over the time, said discrepancies being indicative of possible slackness, loose connections or fatigue on the kinematic chain.

In practice, when a plurality of accelerometers is used, two or more accelerometers can be placed on a single kinematic chain (with a focus to measure separate parts, which are linked together in such a way that they should move together at the pre-defined scenario dependent on the mechanical design), and/or two or more accelerometers can be positioned on a single mechanical part on the kinematic chain at positions that are connected by a fixed connection (such that they should move synchronously at the same time once the driving force is applied). In this way, monitoring of the system can be based on the moment of impact and comparison of the differences between the timing instants of impact which should be instantaneous in the rigidly connected system, to detect possible loosening of the connections. This can be then cross compared with information gathered from accelerometers positioned on a single mechanical part on the kinematic chain to detect if this looseness is causing excessive forces on a specific part within a mechanical chain.

Monitoring of the system can also be made by calculating the velocity of the different parts and its deviation from the theoretical values, and comparing this with specific stresses on the parts of the system (using information gathered from accelerometers positioned on a single mechanical part on the kinematic chain) one can detect the increase in friction of the system, and by comparing the stresses on the parts, can detect the location where the friction was introduced. Finally, by comparing the signals in the frequency domain, identifying specific Eigen-frequencies connected to specific oscillations, as well as their damping changes in these parameters can be detected. In addition the relative phase difference of several points along the connected parts can be used to detect deviations in the system, e.g., friction in a bearing/changes in the masses etc. can lead to a change of the relative phase, that is the oscillation mode. In general, the information gathered through acceleration data of the kinematic chain can be used also to analyze the different mechanical parts of the switching unit, by extracting features of the AVD signals and analyzing them. By tracking changes in these features, e.g., in the frequency or the damping of oscillations, it is possible to analyze different parts of the mechanical systems, e.g., the spring, the shaft, or the damper.

The monitoring device of the present invention can therefore improve the reliability of the switching unit by informing the user if a mechanical part which failure could have consequences on the main functionality of the switching unit is performing badly, or has failed, thereby preventing more serious failures and damages.

It is worth noting that the monitoring device of the present invention advantage can be a built-in system, which automatizes the set-up process of the switching unit without the need for a special measurement setup. Finally, on-line measurement data from the breakers in field at each opening or closing operation could help the further R&D to optimize and devise new mechanical systems for the switching unit.

Is clear from the above that the monitoring device of the present disclosure has a number of advantages with respect to conventional monitoring devices. With respect to state-of-the-art systems which implement accelerometers to measure mechanical parameters based on indirect measurement of vibrations at stationary points, the device according to the present invention measures directly the acceleration (and consequently velocity and position) of some part of the kinematic chain, thereby provide much more information on the mechanical system. This direct measurement makes it much more robust to changes of the mechanical properties, e.g. due to temperature changes, place where the switching unit is installed and similar ambient problems. A further advantage with respect to state-of-the-art systems for measuring travel curves and velocities is generally lower cost and complexity, due to:

- Lower cost of the electronics itself, due to recent developments in the field of accelerometers;
- Possibility to include it by default in the switching unit or sell it separately to the customer;
- Lower cost and complexity of the maintenance for such a system as it would be attached as an add-on to a mechanical part and would not be a part of the mechanical system itself meaning:
  - a. the failure of the device would not hinder the further operation of the switching unit in any way, but only hinder the monitoring;
  - b. the device itself would be easily replaceable.

Finally, as already mentioned, the device of the present invention allows the on-line continuous measurements in the field with consequent advantages for the safety and reliability of the switching systems (always under control) as well as the gathering of data for further developments.

When multiple accelerometers are used, the following benefits and advantages with respect to state-of-the-art systems can be highlighted:

- Service help for setting up the breaker: the benefit lays on the fact that the multi-accelerator system included in the breaker can be used already during production and also during testing both in the factory and in the field (e.g. during an overhaul), to inform in real time the person which does the setup of the breaker about a possible phase (a) symmetry, giving also indications or directions on the steps necessary to improve this (e.g. number of turns on the push rod connection). This would speed up the initial process of breaker setup, as well as ease of the service, as there is no need for external measurement equipment to be mounted and unmounted. There is also not the risk, that some of this measurement equipment is not removed properly after the test, leading of an additional failure risk.

Online contact simultaneity measurement: the benefit lays on constant information about the state of the system, and would assist service during the maintenance, or even trigger service if the symmetry falls out of the defined range. In connection with the possibility of synchronized switching, it also offers the possibility to operate the breaker in a way that all three contacts are used up in an optimal way.

Online determination of loose mechanical connections or system elasticity: the benefit would lays on automatic service trigger once a mechanical connection becomes worn or for any other reason loose, before this would cause further damage. Service would be pinpointed to the faulty part and the process would be faster. It would also allow to schedule for spare/replacement parts needed for the service, reducing the time needed for repair.

Online measurement of the breaker movement during the operation: the benefit would lays on constant information about the state of the infrastructure where the breaker is installed, and would assist service during the maintenance or even trigger the service if the breaker starts to move (jump) too much during the operations, to check the installation. It also allows for improved measurements of parts of the breaker, as the overall motion of the breaker cannot be distinguished from them.

Several variations can be made to the monitoring device thus conceived, all falling within the scope of the attached claims. In practice, the materials used and the contingent dimensions and shapes can be any, according to requirements and to the state of the art.

The invention claimed is:

1. A monitoring device for switching systems comprising a contact assembly having at least a movable contact and a kinematic chain for actuating said movable contact and opening/closing said contact assembly comprising:

an accelerometer adapted to be positioned on a moving part of said switching system and capable of determining acceleration data of said moving part;

a control unit comprising:

a first processing unit adapted to receive acceleration data measured by said accelerometer and calculate timing instants of predetermined events and motion parameters related to said switching system;

a second processing unit adapted to receive said timing instants of predetermined events and said motion parameters and to use at least one timing instant and at least one motion parameter to calculate electro-mechanical parameters of said switching system indicative of a status of components of said switching system.

2. The monitoring device according to claim 1, wherein said timing instants of predetermined events is calculated by detecting one or more of the following: abrupt change in the acceleration value, appearance or disappearance of a specific frequency content in the acceleration pattern, increasing above or decreasing below a specific acceleration threshold value, abrupt change in the acceleration direction and/or subsequent change in velocity and/or travel directions.

3. The monitoring device according to claim 1, wherein said predetermined event is selected among one or more of the following: opening of the contact assembly, closing of the contact assembly, start of the movement of said moving part, finish of the movement of said moving part, impact with a damper of said switching system, energization of an actuating coil of said switching system.

4. The monitoring device according to claim 1, wherein said motion parameter is selected among one or more of the following: acceleration, velocity or position of a moving part of said switching system.

5. The monitoring device according to claim 1, wherein said electro/mechanical parameter of said switching system is a contact erosion status and in the said at least one timing instant is contact opening/closing instant and said at least one motion parameter is the movable contact absolute position at said opening/closing instant.

6. The monitoring device according to claim 1, wherein said electro/mechanical parameter of said switching system is a spring travel status of an actuating spring of said switching system, said spring travel status being determined by calculating the difference in the position at the start/end timing instants with the position at the contact opening/closing instants.

7. The monitoring device according to claim 1, wherein said electro/mechanical parameter of said switching system is the movable contact speed at predetermined timing instants.

8. The monitoring device according to claim 7, wherein said electro/mechanical parameter of said switching system is the movable contact speed at closing/opening.

9. The monitoring device according to claim 1, wherein said electro/mechanical parameter of said switching system is the movable contact over-travel on opening/closing, said over-travel being determined as positions/instants at the timing instant where the velocity change signs.

10. The monitoring device according to claim 1, wherein said electro/mechanical parameter of said switching system is a status of a damping element of said switching system, said status of the damping element being determined as the difference of the position, velocity or timings at the timing instant of hitting the damper and the position, velocity or timings at the timing instant of the next over-travel.

11. A monitoring device for switching systems comprising a contact assembly having at least a movable contact and a kinematic chain for actuating said movable contact and opening/closing said contact assembly comprising:

an accelerometer adapted to be positioned on a moving part of said switching system and capable of determining acceleration data of said moving part;

a control unit comprising:

a first processing unit adapted to receive acceleration data measured by said accelerometer and calculate timing instants of predetermined events and motion parameters related to said switching system;

a second processing unit adapted to receive said timing instants of predetermined events and said motion parameters and to use at least one timing instant and at least one motion parameter to calculate electro-mechanical parameters of said switching system, further comprising, for each phase, an accelerometer adapted to be positioned on a moving part of each phase of said switching system and capable of determining acceleration data of said moving part, said control unit comprising a third processing unit adapted to determine a difference of a commonality in behavior between the phases.

12. A monitoring device for switching systems comprising a contact assembly having at least a movable contact and a kinematic chain for actuating said movable contact and opening/closing said contact assembly comprising:

a plurality of accelerometers adapted to be positioned at different locations of said kinematic chain of said switching system adapted to be positioned on a moving part of said switching system and capable of determining acceleration data of said moving part;

a control unit comprising:

a first processing unit adapted to receive acceleration data measured by said accelerometers and calculate timing instants of predetermined events and/or motion parameters related to said switching system;

a further accelerometer adapted to be connected to a frame of said switching system and capable of determining acceleration data deriving from full-body movements of said switching system;

a second processing unit adapted to receive said timing instants of predetermined events and/or said motion parameters and to use at least one timing instant and at least one motion parameter and/or at least two timing instants and/or at least two motion parameters to calculate electro/mechanical parameters of said switching system indicative of a status of components of said switching system;

a third processing unit adapted to use acceleration data from the plurality of accelerators to determine a relative motion at a location of said kinematic chain and, using the relative motion, determine a change in a property of said kinematic chain; and a fourth processing unit adapted to use said acceleration data deriving from full-body movements of said switching system to correct acceleration data of said moving part of said switching system.

13. The monitoring device according to claim 12, further comprising a plurality of accelerometers adapted to be positioned at different locations of said kinematic chain positions that are connected by a fixed connection.

14. The monitoring device according to claim 12, further comprising a plurality of accelerometers adapted to be positioned on a single mechanical part on said kinematic chain at positions that are connected by a fixed connection.

15. A monitoring device for switching systems comprising a contact assembly having at least a movable contact and a kinematic chain for actuating said movable contact and opening/closing said contact assembly comprising:

an accelerometer adapted to be positioned on a moving part of said switching system and capable of determining acceleration data of said moving part;

a control unit comprising:

a first processing unit adapted to receive acceleration data measured by said accelerometer and calculate timing instants of predetermined events and motion parameters related to said switching system;

a second processing unit adapted to receive said timing instants of predetermined events and said motion parameters and to use at least one timing instant and at least one motion parameter to calculate electro-mechanical parameters of said switching system, which further comprises a further accelerometer adapted to be connected to a frame of said switching system and capable of determining acceleration data deriving from full-body movements of said switching system, said control unit comprising a third processing unit adapted to use said acceleration data deriving from full-body movements to correct acceleration data of said moving part of said switching system.

16. A switching system comprising a monitoring device according to claim 1.

17. A medium voltage switchgear comprising a monitoring device according to claim 1.

18. A method for monitoring a switching system comprising a contact assembly having at least a movable contact and a kinematic chain for actuating said movable contact and opening/closing said contact assembly comprising:

positioning a first accelerometer on a moving part of said switching system;

positioning a second accelerometer to a frame of said switching system;

determining acceleration data of said moving part;

determining acceleration data deriving from full-body movements of said switching system;

correcting, using acceleration data derived from full-body movements of said switching system, acceleration data of said moving part;

calculating, using said acceleration data, timing instants of predetermined events;

calculating, using said acceleration data, motion parameters related to said switching system;

calculating, using at least one of said timing instants and at least one of said motion parameters, electro/mechanical parameters of said switching system.

19. The method according to claim 18, wherein said electro/mechanical parameter of said switching system is a contact erosion status and in that said at least one timing instant is the contact opening/closing instant and said at least one motion parameter is the movable contact absolute position at said opening/closing instant.

20. The method according to claim 18, wherein said electro/mechanical parameter of said switching system is the movable contact speed at predetermined timing instants and in that said at least one timing instant is the contact closing/opening instant and said at least one motion parameter is the movable contact speed at closing/opening.

* * * * *